US005920958A

United States Patent [19]

Domenig et al.

[11] Patent Number: 5,920,958

[45] Date of Patent: Jul. 13, 1999

[54] ADJUSTABLE FURNITURE HINGE

[75] Inventors: Georg Domenig; Andreas Moser, both of Kernersville, N.C.

[73] Assignee: Grass America, Inc., Kernersville, N.C.

[21] Appl. No.: 08/939,363

[22] Filed: Sep. 29, 1997

[51] Int. Cl.[6] ..... E05D 7/04

[52] U.S. Cl. ..... 16/237; 16/238; 16/240; 16/245

[58] Field of Search ..... 16/237, 238, 240, 16/245, 246

[56] References Cited

U.S. PATENT DOCUMENTS

| | | | |
|---|---|---|---|
| 4,850,080 | 7/1989 | Rock et al. | 16/236 |
| 4,976,006 | 12/1990 | Lautenschlager | 16/238 |
| 5,511,287 | 4/1996 | Lautenschlager et al. | 16/239 |

FOREIGN PATENT DOCUMENTS

| | | | |
|---|---|---|---|
| 3640547 | 1/1988 | Germany | 16/245 |

*Primary Examiner*—Anthony Knight
*Assistant Examiner*—Alison K. Pickard
*Attorney, Agent, or Firm*—John M. Harrington; Kilpatrick Stockton LLP

[57] ABSTRACT

An adjustable hinge for mounting a door on a frame of a furniture article includes a hinge arm with a first end portion articulated to the first hinge and with a second end portion on which is formed an adjustment member with a threaded adjustment screw opening and a pair of opposing lateral edge portions with depending flanges, each having a recess with a forward end having an abutment surface and a rearward end having a hook. The hinge also includes a second hinge member having portions defining an adjustment screw opening and a pair of opposing lateral edge portions with upstanding flanges, each of which has a forward projection and a rearward projection. The rearward projection pivotably engages the hook of the recess in the depending flange of the adjustment member with the forward projection confronting the abutment surface of the recess of the depending ledge of the adjustment member. Threaded adjustment of an adjustment screw received in the adjustment screw opening of the second hinge member and threaded into the threaded adjustment screw opening of the adjustment member causes the adjustment plate to pivot relative to the second hinge member about the rearward projections on the upstanding flanges of the second hinge member.

19 Claims, 5 Drawing Sheets

ADJUSTABLE FURNITURE HINGE

BACKGROUND OF THE INVENTION

1. Field of the Invention

The present invention relates to a hinge for mounting a door on frame of a furniture article and more particularly to a hinge with an adjustable hinge arm which enables adjustment of the mounted door relative to the supporting frame.

2. Description of the Prior Art

Various types of hinges for mounting a door on a furniture article such as a desk or cabinet have been used in the furniture and cabinetry industry for many years. One such device is known from U.S. Pat. No. 5,621,947, in which a hinge arm is riveted to a mounting plate in an undetachable and rigid connection, so that adjustment of the hinge arm results primarily from flexing of the hinge arm or the mounting plate, prevents use of hardened metal for one or both of the hinge arm and the mounting plate, and severely limits the range of adjustment. Other such devices include multiple adjustment components, making them bulky, difficult to adjust, quick to wear, and unstable. To provide adjustable hinges that are operable with greater efficiency and more precise reliability, it has been determined that more refined design engineering skills are required, and the present invention addresses this need and interest.

SUMMARY OF THE INVENTION

The general purpose of the present invention, which will be described subsequently in greater detail, is to provide a new and improved hinge for mounting a door on a frame of a furniture article such as a cabinet or desk and with an adjustable hinge arm for adjusting the door relative to the supporting frame, that has all of the advantages of prior art hinges and none of the disadvantages. In order to attain this purpose, a representative embodiment of the present invention is illustrated in the drawings. The hinge of the present invention makes use of a first hinge member in the form of a hinge cup which is mountable flush in a bore hole with fastening screws in the back of a door and a second hinge member adapted to be affixed to a frame with a fastening screw. The second hinge member includes a substantially flat portion with an opening through which a fastening screw can be driven into the frame.

The hinge of the present invention also includes a hinge arm having a first end portion which is articulated or pivoted to the first hinge member on a hinge axis such as a hinge pin which is disposed or fastened in the first hinge member. The hinge arm also has a second end portion on which is formed an adjustment member. The hinge arm, including its first end portion and its second end portion with the adjustment member, is formed as one piece. The adjustment member includes a threaded adjustment screw opening which is disposed near a forward edge of the adjustment member. The adjustment member also includes a pair of opposing lateral edge portions, each having a depending flange in which is formed a recess. The depending flanges extend parallel to one another and perpendicular to the hinge axis, and the recesses likewise extend parallel to one another and perpendicular to the hinge axis. Each of the recesses has a forward end with an abutment surface, and a rearward end with a hook.

The second hinge member includes an adjustment screw opening which is defined as a slotted hole that extends to and is open all the way out to the forward edge of the second hinge member and is spaced apart from the fastening screw opening. The second hinge member also includes a pair of opposing lateral edge portions, each of which includes an upstanding flange. The upstanding flanges extend parallel to one another and perpendicular to the hinge axis. Each of the upstanding flanges has a forward projection and a rearward projection. The adjustment member is pivotably connected to the second hinge member by the rearward projection pivotably engaging the hooks and with the forward projections slideably confronting the abutment surfaces.

Preferably, a pair of opposing positioning members are provided on the opposing lateral edge portions of the second hinge member near the forward projections, which lie adjacent the depending flanges of the adjustment member to prevent lateral movement of the adjustment member relative to the second hinge member. Additionally, another pair of opposing positioning members may be provided on the opposing lateral edge portions of the second hinge member near the rearward projections, which likewise lie adjacent the depending flanges of the adjustment member to further prevent lateral movement of the adjustment member relative to the second hinge member. Further, an access opening is provided in the adjustment member to provide convenient access to the fastening screw, which affixes the second hinge member to the frame.

The adjustment screw is configured substantially as a set screw without an enlarged diameter screw head, but rather with threads which extend the entire length of the adjustment screw, except for an unthreaded portion near the bottom end of the adjustment screw, which has a somewhat smaller diameter than the threaded portion of the adjustment screw. Preferably, both the bottom end and the top end of the adjustment screw are provided with an adjustment tool engaging slot for threaded adjustment of the adjustment screw from either end of the adjustment screw. The unthreaded portion of the adjustment screw is received in the slotted adjustment screw opening of the second hinge member through the opening in the forward edge of the second hinge member. The length of the unthreaded portion of the adjustment screw is substantially equal to the thickness of the second hinge member, so that the adjustment screw is prevented from moving vertically relative to the second hinge member, once it is so received. Thereafter, the top end of the adjustment screw is threaded into the threaded adjustment screw opening of the adjustment member from the bottom side of the adjustment member.

Adjustment of the adjustment member relative to the second hinge member is accomplished with threaded adjustment of the adjustment screw in the threaded adjustment screw opening of the adjustment member. Thus, turning the adjustment screw in the threaded adjustment screw opening causes the adjustment member to pivot relative to the second hinge member about an axis defined by the rearward projections on the upstanding flanges of the second hinge member pivotably engaging the hooks on the depending flanges of the adjustment member, with the forward projections on the upstanding flanges of the second hinge member sliding on the abutment surfaces of the recesses of the depending flanges. The purpose of such adjustment is to reposition the hinge arm and the door relative to the second hinge member and the frame.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways.

It is to be further understood that the phraseology and terminology employed herein are for the purpose of description and are not to be regarded as limiting. Those skilled in the art will appreciate that the conception on which this disclosure is based may readily be used as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved hinge for mounting a door on a frame of a furniture article such as a desk or cabinet which has all of the advantages, and more, of prior art devices and none of the disadvantages.

It is another object of the present invention to provide a new and improved hinge for mounting a door on a frame of a furniture article that is more reliable and functional that those presently available.

Yet another object of the present invention is to provide a new and sophisticated, precision made adjustable hinge that is compact, can operate reliably and efficiently, and yet enable renewed, preselected limited adjustments to be made to the mounted door with respect to the frame of the furniture article.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, reference should be made to the accompanying drawings in which like characters of reference designate like parts throughout the several views.

BRIEF DESCRIPTION OF THE DRAWING

This invention will be better understood and objects other than those set forth above, will become apparent when consideration is given to the following detailed description. Such description makes reference to the annexed drawings wherein.

DESCRIPTION OF THE PREFERRED EMBODIMENT

Figure 1:
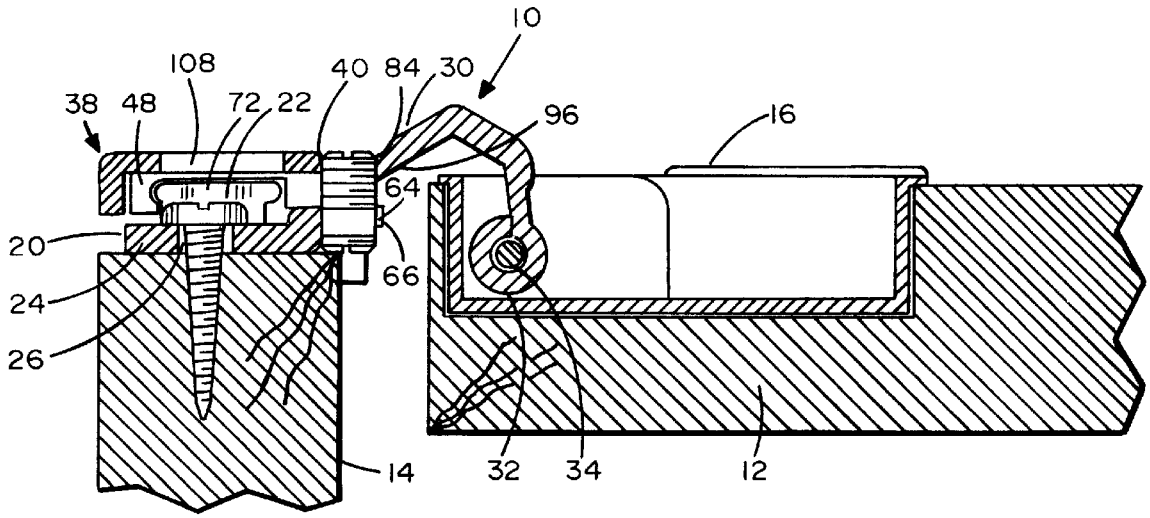
FIG. 1 is a partial section view of a hinge of the present invention mounted on a door and supporting frame member with the hinge in the open position.
Figure 2:
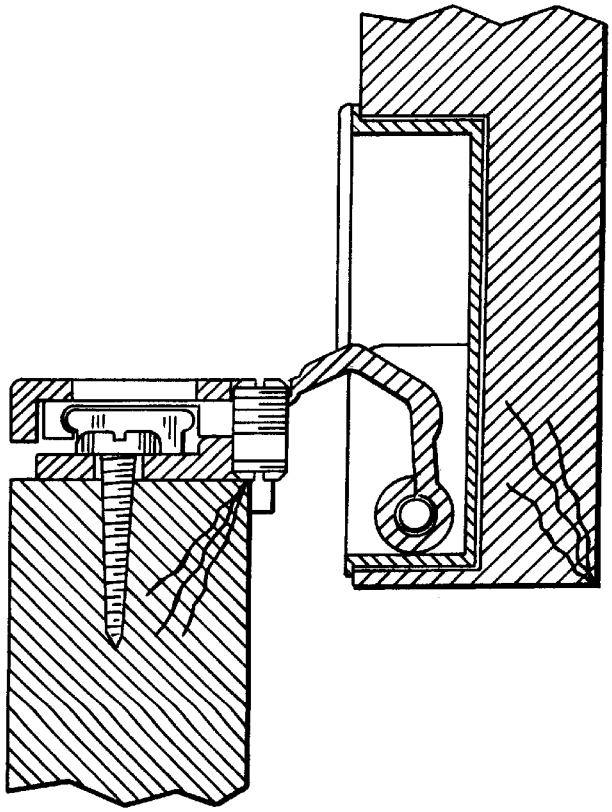
FIG. 2. is a partial section view of the hinge of FIG. 1 mounted on a door and supporting frame member with the hinge in a closed position.
Figure 3:
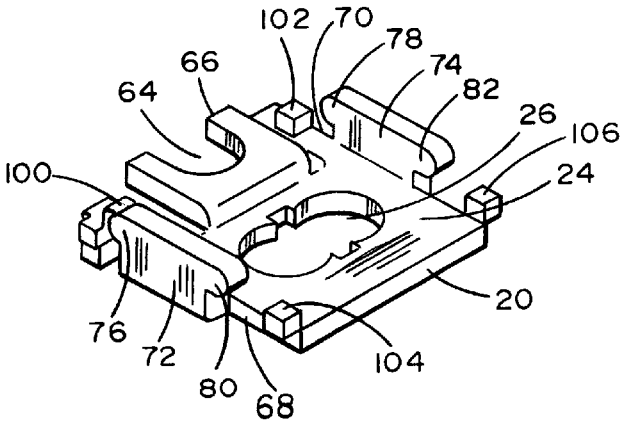
FIG. 3 is a perspective view of the second hinge member of the hinge of FIG. 1.
Figure 5:
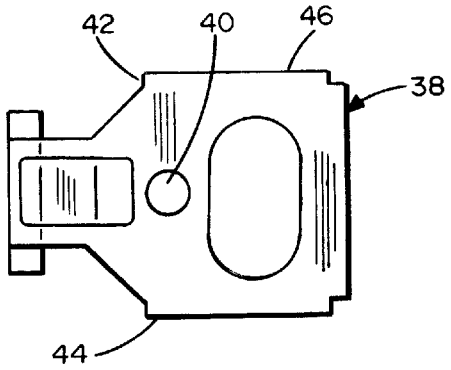
FIG. 5 is a top plan view of the hinge arm of the hinge of FIG. 1.
Figure 6:
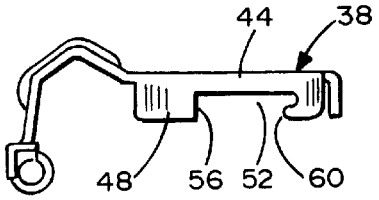
FIG. 6 is a left side elevational view of the hinge arm of the hinge of FIG. 1.
Figure 9:
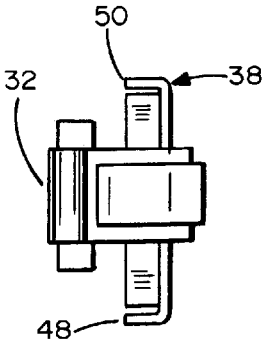
FIG. 9 is a front elevational view of the hinge arm of the hinge of FIG. 1.
Figure 7:
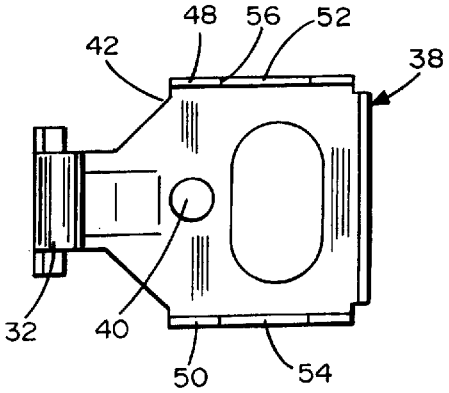
FIG. 7 is a bottom plan view of the hinge arm of the hinge of FIG. 1.
Figure 10:
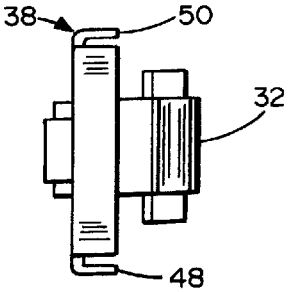
FIG. 10 is a rear elevational view of the hinge arm of the hinge of FIG. 1.
Figure 8:
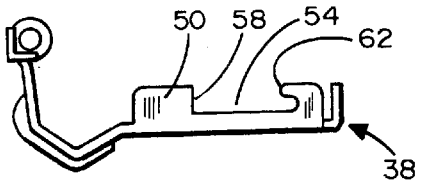
FIG. 8 is a right side elevational view of the hinge arm of the hinge of FIG. 1.
Figure 11:
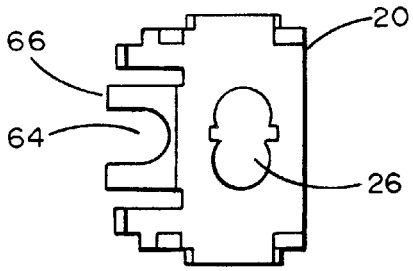
FIG. 11 is a bottom plan view of the second hinge member of the hinge of FIG. 1.
Figure 12:
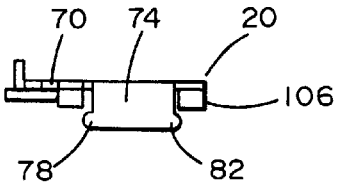
FIG. 12 is a right side elevational view of the second hinge member of the hinge of FIG. 1.
Figure 15:
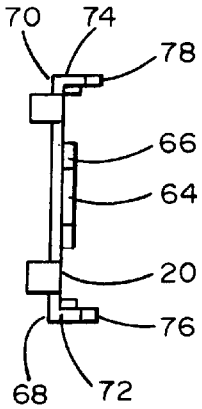
FIG. 15 is a front elelvational view of the second hinge member of the hinge of FIG. 1.
Figure 13:
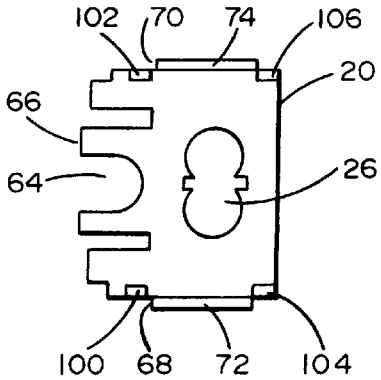
FIG. 13 is a top plan view of the second hinge member of the hinge of FIG. 1.
Figure 16:
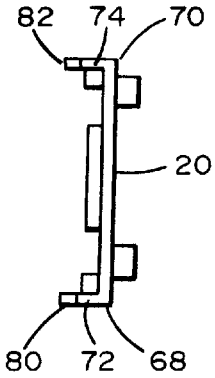
FIG. 16 is a rear elevational view of the second hinge member of the hinge of FIG. 1.
Figure 14:
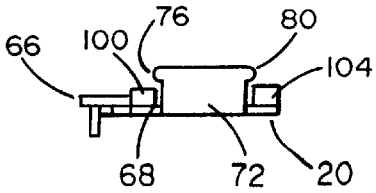
FIG. 14 is a left side elevational view of the second hinge member of the hinge of FIG. 1.

Referring now to the drawings and particularly to FIG. 1, the hinge of the present invention shown generally as 10 in FIG. 1, serves to hang a door 12 on a frame 14 of a furniture article such as a cabinet. Frame 14 defines a door opening (not shown) on which door 12 is open in the position of hinge 10 shown in FIG. 1 and closed in the position of hinge 10 shown in FIG. 2. Hinge 10 includes a first hinge member 16 in the form of a hinge cup mountable flush in a bore hole with fastening screws (not shown) in the back of door 12, as shown in FIG. 1, and a second hinge member 20 adapted to be affixed to frame 14 with a fastening screw 22. Referring to FIGS. 1 and 3, second hinge member 20 includes a substantially flat portion 24 with an opening 26 through which a fastening screw 22 can be driven into frame 14.

Figure 4:
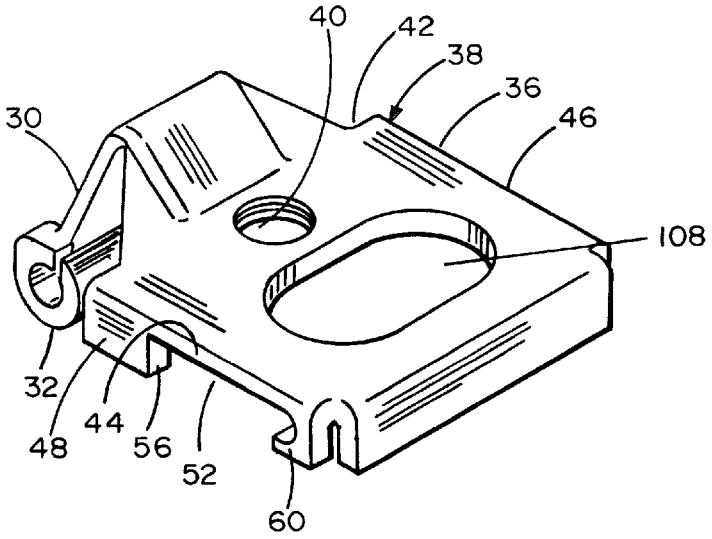
FIG. 4 is a perspective view of the hinge arm of the hinge of FIG. 1.

Referring to FIGS. 1 and 4, hinge 10 also includes a hinge arm 30 having a first end portion 32 articulated or pivoted to first hinge member 16 on a hinge axis such as hinge pin 34 disposed or fastened in first hinge member 16. Hinge arm 30 also has a second end portion 36 on which is formed an adjustment member 38 as shown in FIG. 4. Accordingly, hinge arm 30, including its first end portion 32 and its second end portion 36 with adjustment member 38, is formed as one piece. Referring to FIGS. 4–10, adjustment member 38 includes a threaded adjustment screw opening 40 disposed near a forward edge 42 of adjustment member 38. Adjustment member 38 also includes a pair of opposing lateral edge portions 44, 46, each having a depending flange 48, 50 in which is formed a recess 52, 54. Depending flanges 48, 50 extend parallel to one another and perpendicular to hinge axis 34, and recesses 52, 54 likewise extend parallel to one another and perpendicular to hinge axis 43. Each of recesses 52, 54 has a forward end with an abutment surface 56, 58 and a rearward end with a hook 60, 62.

Referring to FIGS. 3 and 11–16, second hinge member 20 includes an adjustment screw opening 64 which is defined as a slotted hole that extends to and is open all the way out to the forward edge 66 of second hinge member 20 and is spaced apart from fastening screw opening 26. Second hinge member 20 also includes a pair of opposing lateral edge portions 68, 70, each including an upstanding flange 72, 74 which extend parallel to one another and perpendicular to hinge axis 34. Each of upstanding flanges 72, 74 has a forward projection 76, 78 and a rearward projection 80, 82. Adjustment member 38 is pivotably connected to second hinge member 20 by rearward projections 80, 82 pivotably engaging hooks 60, 62 with forward projections 76, 78 slideably confronting abutment surfaces 56, 58.

Preferably, a pair of opposing positioning members 100, 102 are provided on opposing lateral edge portions 68, 70 of second hinge member 20 near forward projections 76, 78, which lie adjacent depending flanges 48, 50 of adjustment member 38 to prevent lateral movement of adjustment member 38 relative to second hinge member 20. Additionally, another pair of opposing positioning members 104, 106 may be provided on opposing lateral edge portions 68, 70 of second hinge member 22 near rearward projections 80, 82, which likewise lie adjacent depending flanges 48, 50 of adjustment member 38 to further prevent lateral movement of adjustment member 38 relative to second hinge member 20. Further, an access opening 108 is provided in adjustment member 38 to provide convenient access to fastening screw 22.

Figure 17:
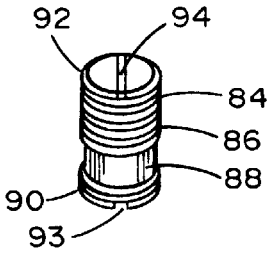
FIG. 17 is a perspective view of the adjustment screw of the hinge of FIG. 1.
Figure 18:
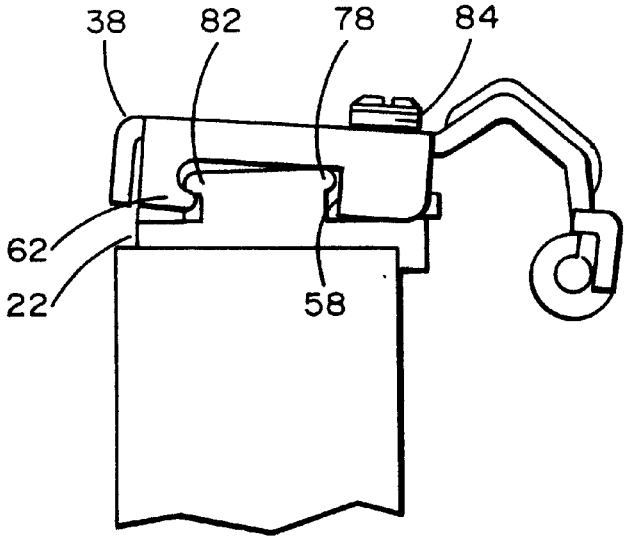
FIG. 18 is a partial right side elevational view of the hinge arm and second hinge member of the hinge of FIG. 1 in a first adjusted position.
Figure 19:
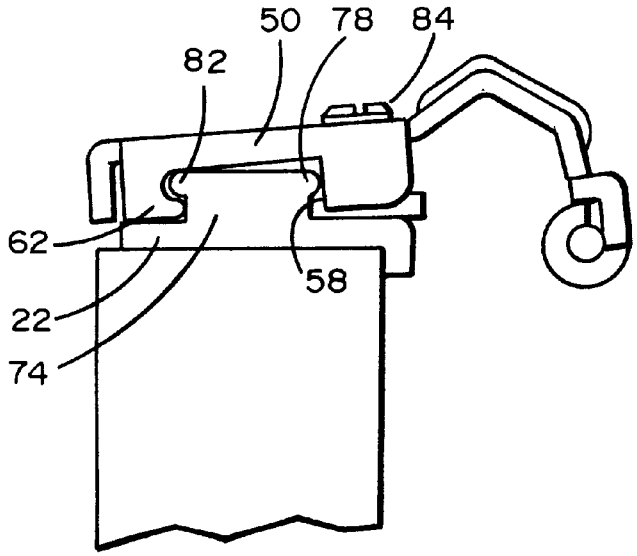
FIG. 19 is a partial right side elevational view of the hinge arm and second hinge member of the hinge of FIG. 1 in a second adjusted position.

Referring now to FIGS. 1 and 17, adjustment screw 84 is configured substantially as a set screw without an enlarged diameter screw head, but rather with threads 86 which extend its entire length, except for an unthreaded somewhat narrower portion 88 near its bottom end 90. Preferably, both bottom end 90 and top end 92 of adjustment screw 84 include adjustment tool engaging slots 93, 94, for threaded adjustment from either end 90, 92 of adjustment screw 84. Unthreaded portion 88 of adjustment screw 84 is received in slotted adjustment screw opening 64 through the forward edge 66 of second hinge member 20. The length of unthreaded portion 88 is substantially equal to the thickness of second hinge member 20, so adjustment screw 84 is prevented from moving vertically relative to second hinge member 20. Thereafter, top end 92 of adjustment screw 84 is threaded into threaded adjustment screw opening 40 from the bottom side 96 of adjustment member 38. Adjustment of adjustment member 38 relative to second hinge member 20 is accomplished with threaded adjustment of adjustment screw 84 in threaded adjustment screw opening 40. In other words, turning adjustment screw 84 in threaded adjustment screw opening 40 causes adjustment member 38 to pivot relative to second hinge member 20 about an axis defined by rearward projections 80, 82 pivotably engaging hooks 60, 62 with forward projections 76, 78 sliding on abutment surfaces 56, 58 between positions illustrated in FIGS. 18 and 19. The purpose of such adjustment is to reposition hinge arm 30 and door 12 relative to second hinge member 20 and frame 14.

With respect to the descriptions set forth above, optimum dimensional relationship of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principal of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A hinge for mounting a door on a frame of a furniture article, comprising:

a first hinge member adapted to be affixed to the door;

a hinge arm having a first end portion articulated to the first hinge member on a hinge axis disposed in the first hinge member and having a second end portion on which is formed an adjustment member with portions defining a threaded adjustment screw opening, the adjustment member also having a pair of opposing lateral edge portions with a recess formed in each lateral edge portion, each recess having a forward end with an abutment surface and a rearward end with a hook;

a second hinge member adapted to be mounted on the frame, the second hinge member having portions defining an adjustment screw opening, the second hinge member also having a pair of opposing lateral edge portions, each lateral edge portion of the second hinge member having a forward projection and a rearward projection, and the rearward projection pivotably engages the hook of the recess in the lateral edge portion of the adjustment member with the forward projection slidably confronting the abutment surface of said recess; and an adjustment screw received in the adjustment screw opening of the second hinge member and threaded into the threaded adjustment screw opening of the ajustment member, and threaded adjustment of the adjustment screw causing the adjustment plate to pivot relative to the second hinge member about the respective rearward projections of the opposing lateral edge portions of the second hinge member, to describe an angle between the adjustment plate and the second hinge member.

2. The hinge according to claim 1, wherein said recesses extend parallel to one another.

3. The hinge according to claim 1, wherein said recesses extend perpendicular to said hinge axis.

4. The hinge according to claim 1, wherein each of said opposing lateral edge portions of the adjustment member includes a depending flange, the depending flanges extend parallel to one another, and said recesses are formed in the depending flanges and likewise extends parallel to one another.

5. The hinge according to claim 1, wherein each of said opposing lateral edge portions of the adjustment member includes a depending flange extending perpendicular to said hinge axis, and said recesses are formed in the depending flanges and likewise extends perpendicular to the hinge axis.

6. The hinge according to claim 1, wherein said second hinge member has a forward edge, and said adjustment screw opening in the second hinge member is defined as a slotted hole that extends to and is open at the forward edge of the second hinge member.

7. The hinge according to claim 1, wherein said second hinge member has portions defining a fastening screw opening, and said adjustment screw opening in the second hinge member is spaced apart from the fastening screw opening.

8. The hinge according to claim 1, wherein each of said opposing lateral edge portions of the second hinge member includes an upstanding flange, the upstanding flanges extend parallel to one another, and said forward and rearward projections are formed on the upstanding flanges.

9. The hinge according to claim 1, wherein each of said opposing lateral edge portions of the second hinge member includes an upstanding flange, the upstanding flanges extend perpendicular to said hinge axis, and said forward and rearward projections are formed on the upstanding flanges.

10. The hinge according to claim 1, wherein each of said opposing lateral edge portions of the second hinge member has a forward positioning member proximate said forward projection which engages one of said opposing lateral edge portions of the adjustment member.

11. The hinge according to claim 1, wherein each of said opposing lateral edge portions of the second hinge member has a rearward positioning member proximate said rearward projection which engages one of said opposing lateral edge portions of the adjustment member.

12. The hinge according to claim 1, wherein said adjustment screw has threaded and unthreaded portions, and the unthreaded portion is received in said adjustment screw opening of the second hinge member.

13. The hinge according to claim 1, wherein said adjustment member has a top side and a bottom side, and said adjustment screw has a threaded top end which is threaded into said threaded adjustment screw opening of the adjustment member from the bottom side of the adjustment member.

14. The hinge according to claim 2, wherein each of said opposing lateral edge portions of the adjustment member includes a depending flange, the depending flanges extend parallel to one another and perpendicular to said hinge axis, and said recesses are formed in the depending flanges and likewise extend parallel to one another and perpendicular to the hinge axis.

15. The hinge according to claim 14, wherein said second hinge member has a forward edge and also has portions defining a fastening screw opening, and said adjustment screw opening in the second hinge member is defined as a slotted hole that extends to and is open at the forward edge of the second hinge member and is spaced apart from the fastening screw opening.

16. The hinge according to claim 15, wherein each of said opposing lateral edge portions of the second hinge member includes an upstanding flange, the upstanding flanges extending parallel to one another and perpendicular to said hinge axis, and said forward and rearward projections are formed on the upstanding flanges.

17. The hinge according to claim 16, wherein said adjustment screw has threaded and unthreaded portions, and the unthreaded portion is received in said adjustment screw opening of the second hinge member.

18. The hinge according to claim 17, wherein said adjustment member has a top side and a bottom side, and said adjustment screw has a threaded top end which is received into said threaded adjustment screw opening of the adjustment member from the bottom side of the adjustment member.

19. The hinge according to claim 18, wherein each of said opposing lateral edge portions of the second hinge member has at least one positioning member proximate one of said forward and rearward projections which engages one of said opposing lateral edge portions of the adjustment member.

* * * * *